US010825440B2

(12) United States Patent
Alderson et al.

(10) Patent No.: US 10,825,440 B2
(45) Date of Patent: Nov. 3, 2020

(54) SYSTEM AND METHOD FOR CALIBRATING AND TESTING AN ACTIVE NOISE CANCELLATION (ANC) SYSTEM

(71) Applicant: Cirrus Logic International Semiconductor Ltd., Edinburgh (GB)

(72) Inventors: Jeffrey Alderson, Austin, TX (US); Ning Li, Cedar Park, TX (US); Ronald Coapstick, Austin, TX (US)

( * ) Notice: Subject to any disclaimer, the term of this patent is extended or adjusted under 35 U.S.C. 154(b) by 69 days.

(21) Appl. No.: 16/264,409

(22) Filed: Jan. 31, 2019

(65) Prior Publication Data

US 2020/0005759 A1 Jan. 2, 2020

Related U.S. Application Data

(60) Provisional application No. 62/624,990, filed on Feb. 1, 2018.

(51) Int. Cl.

| | |
|---|---|
| ***G10K 11/178*** | (2006.01) |
| ***H04R 1/40*** | (2006.01) |
| ***H04R 3/00*** | (2006.01) |
| ***H04R 29/00*** | (2006.01) |

(52) U.S. Cl.

CPC .. *G10K 11/17833* (2018.01); *G10K 11/17857* (2018.01); *G10K 11/17881* (2018.01); *H04R 1/406* (2013.01); *H04R 3/005* (2013.01); *H04R 29/005* (2013.01); *G10K 2210/504* (2013.01)

(58) Field of Classification Search

None

See application file for complete search history.

(56) References Cited

U.S. PATENT DOCUMENTS

| | | | | |
|---|---|---|---|---|
| 8,358,787 | B2 * | 1/2013 | Lee | H04R 29/001 381/58 |
| 8,401,200 | B2 * | 3/2013 | Tiscareno | H04R 1/1016 381/58 |
| 2002/0146136 | A1 | 10/2002 | Carter, Jr. | |
| 2009/0116656 | A1 * | 5/2009 | Lee | H04R 29/001 381/59 |
| 2010/0124336 | A1 * | 5/2010 | Shridhar | G10K 11/17827 381/71.4 |

(Continued)

FOREIGN PATENT DOCUMENTS

WO WO2017066708 A2 4/2017

*Primary Examiner* — Paul W Huber

(57) ABSTRACT

A method for calibrating an ANC-enabled portable audio device having microphones plays continuously a calibration sound by a calibrated speaker of a test station separate from the device. For each microphone of all the microphones, a microphone calibration value is computed using a comparison of a predetermined level and a measured level of an audio signal transduced by the microphone in response to the continuously-played calibration sound. The calibration is done without using a microphone of the test station. A processing element of the device may be programmed to make the comparison and computation. The processing element also causes a speaker of the device to generate a second calibration sound, measures a second level while the computed calibration value is applied to one of microphones (e.g., error microphone), and computes a calibration value for the device speaker using a comparison of a predetermined level and the second level.

26 Claims, 9 Drawing Sheets

(56) References Cited

U.S. PATENT DOCUMENTS

| | | | | |
|---|---|---|---|---|
| 2011/0222696 | A1* | 9/2011 | Balachandran | H04R 29/001 381/58 |
| 2012/0269356 | A1 | 10/2012 | Sheerin et al. | |
| 2012/0300952 | A1 | 11/2012 | Burnett | |
| 2015/0228292 | A1* | 8/2015 | Goldstein | G10L 21/0208 381/71.6 |
| 2017/0200444 | A1* | 7/2017 | O'Connell | G10K 11/17881 |
| 2018/0018984 | A1* | 1/2018 | Dickins | G10L 21/0232 |
| 2018/0122357 | A1* | 5/2018 | Thornock | G10K 11/1783 |
| 2020/0029162 | A1* | 1/2020 | Matsunaga | G10L 15/20 |
| 2020/0100709 | A1* | 4/2020 | Shennib | A61B 5/123 |

* cited by examiner

SYSTEM AND METHOD FOR CALIBRATING AND TESTING AN ACTIVE NOISE CANCELLATION (ANC) SYSTEM

CROSS REFERENCE TO RELATED APPLICATION(S)

This application claims priority based on U.S. Provisional application, Ser. No. 62/624,990, filed Feb. 1, 2018, entitled METHOD FOR CALIBRATING AND TESTING AN ANC SYSTEM, which is hereby incorporated by reference in its entirety.

BACKGROUND

Wireless telephones, such as mobile/cellular telephones, cordless telephones, and other consumer audio devices, such as mp3 players, are in widespread use. Performance of such devices with respect to intelligibility can be improved by providing noise canceling, such as active noise cancellation (ANC), using a microphone to measure ambient acoustic events and then using signal processing to insert an anti-noise signal into the output of the device to cancel the ambient acoustic events.

Component tolerance and assembly issues are important considerations in modern manufacturing of electronic devices that employ ANC. ANC performance depends heavily on the absolute sensitivity of the microphones and speakers included in the electronic device, e.g., headphones. The sensitivity of a microphone is a measure of the amount of electrical output signal the microphone produces (e.g., in Volts) in response to a known amount of sound (e.g., in decibels). Conversely, the sensitivity of a speaker is a measure of the amount of sound (e.g., in decibels) the speaker produces in response to a known electrical input signal (e.g., in Watts). The microphones and speakers may have a wide manufacturing tolerance. Calibration may take a long time and require significant complexity on the manufacturing line of an ANC system. Internal leakage paths from speaker to reference microphone due to poor sealing may also affect ANC performance.

SUMMARY

In one embodiment, the present disclosure provides method for calibrating an active noise cancellation (ANC)-enabled portable audio device having microphones. The method includes playing continuously a calibration sound by a calibrated speaker of a test station that is separate from the portable audio device. The method also includes, for each microphone of all the microphones of the portable audio device: measuring a level of an audio signal transduced by the microphone in response to the continuously-played calibration sound, making a comparison of a predetermined level and the measured level, and computing a calibration value for the microphone using the comparison. The measuring, the making the comparison and the computing the calibration value are performed for all of the microphones of the portable audio device without using a microphone of the test station and in response to the continuously-played calibration sound.

In another embodiment, the present disclosure provides an ANC-enabled portable audio device. The device includes a speaker, at least one microphone, and a processing element. The processing element within the ANC-enabled portable audio device is programmed to measure an audio signal transduced by the at least one microphone in response to a calibration sound, make a comparison of a predetermined level and a level of the measured audio signal, and compute a calibration value for the at least one microphone using the comparison.

DETAILED DESCRIPTION

Figure 1A:
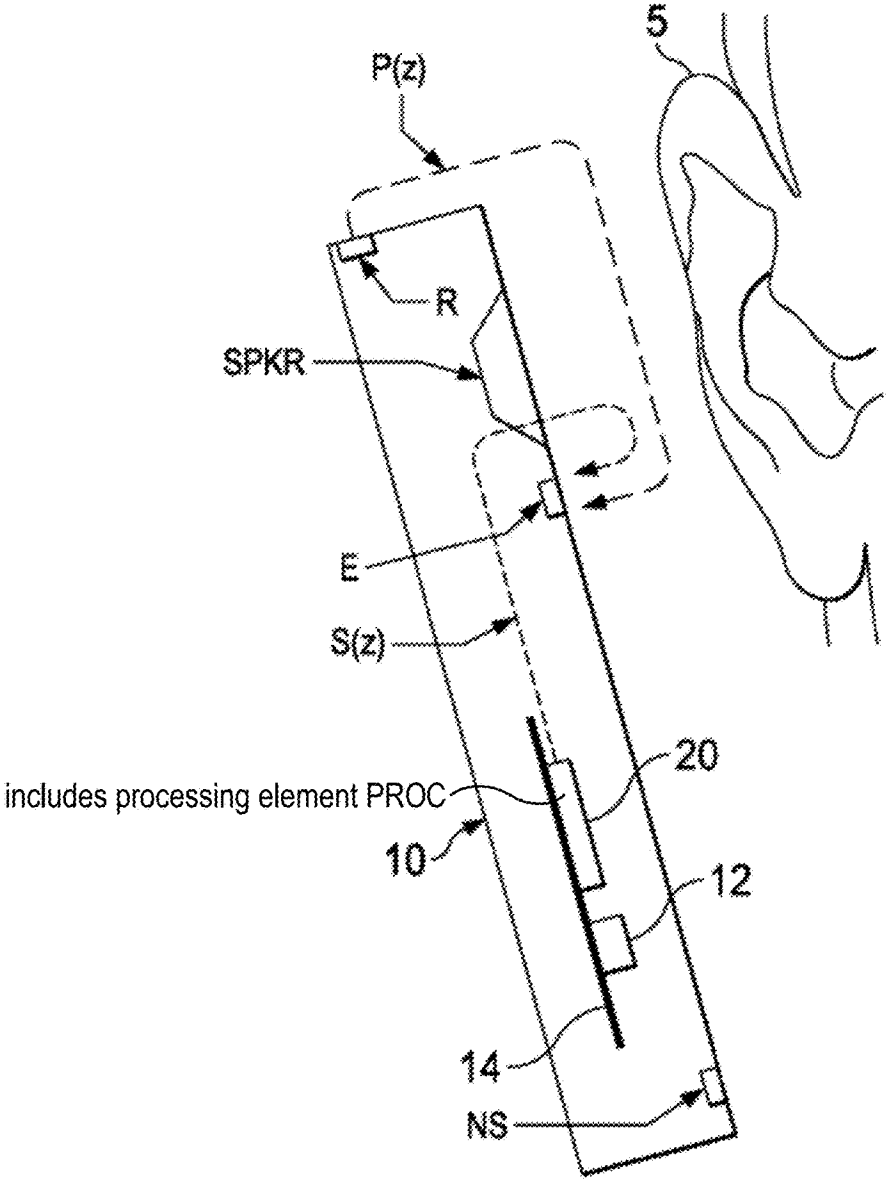
FIG. 1A is an illustration of an example wireless telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of an ANC-enabled portable audio device in which techniques in accordance with embodiments of this disclosure may be employed, but it is understood that not all of the elements or configurations embodied in illustrated wireless telephone 10, or in the circuits depicted in subsequent illustrations, are required in order to practice the inventions recited in the claims. Wireless telephone 10 may include a transducer such as a speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In other embodiments, additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the portable audio device, such as an MP3 player-on-a-chip integrated circuit. In these and other embodiments, the circuits and techniques disclosed herein may be implemented partially or fully in software and/or firmware embodied in computer-readable media and executable by a controller or other processing device, such as processing element PROC of IC 20 that may perform operations for calibration and testing of an ANC system of the portable audio device as described herein. A processing element is an electronic circuit capable of fetching program instructions stored in addressed memory locations and executing the fetched instructions. IC 20 may also include a non-volatile memory for storing calibration values obtained during calibration as described in more detail below.

In general, the ANC system of portable audio device 10 measures ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects and embodiments of the present disclosure may be practiced in a system that does not include separate error and reference microphones, or a wireless telephone that uses near-speech microphone NS to perform the function of the reference microphone R. Also, in portable audio devices designed only for audio playback, near-speech microphone NS will generally not be included, and the near-speech signal paths in the circuits described in further detail below may be omitted, without changing the scope of the disclosure, other than to limit the options provided for input to the microphone covering detection schemes.

Figure 1B:
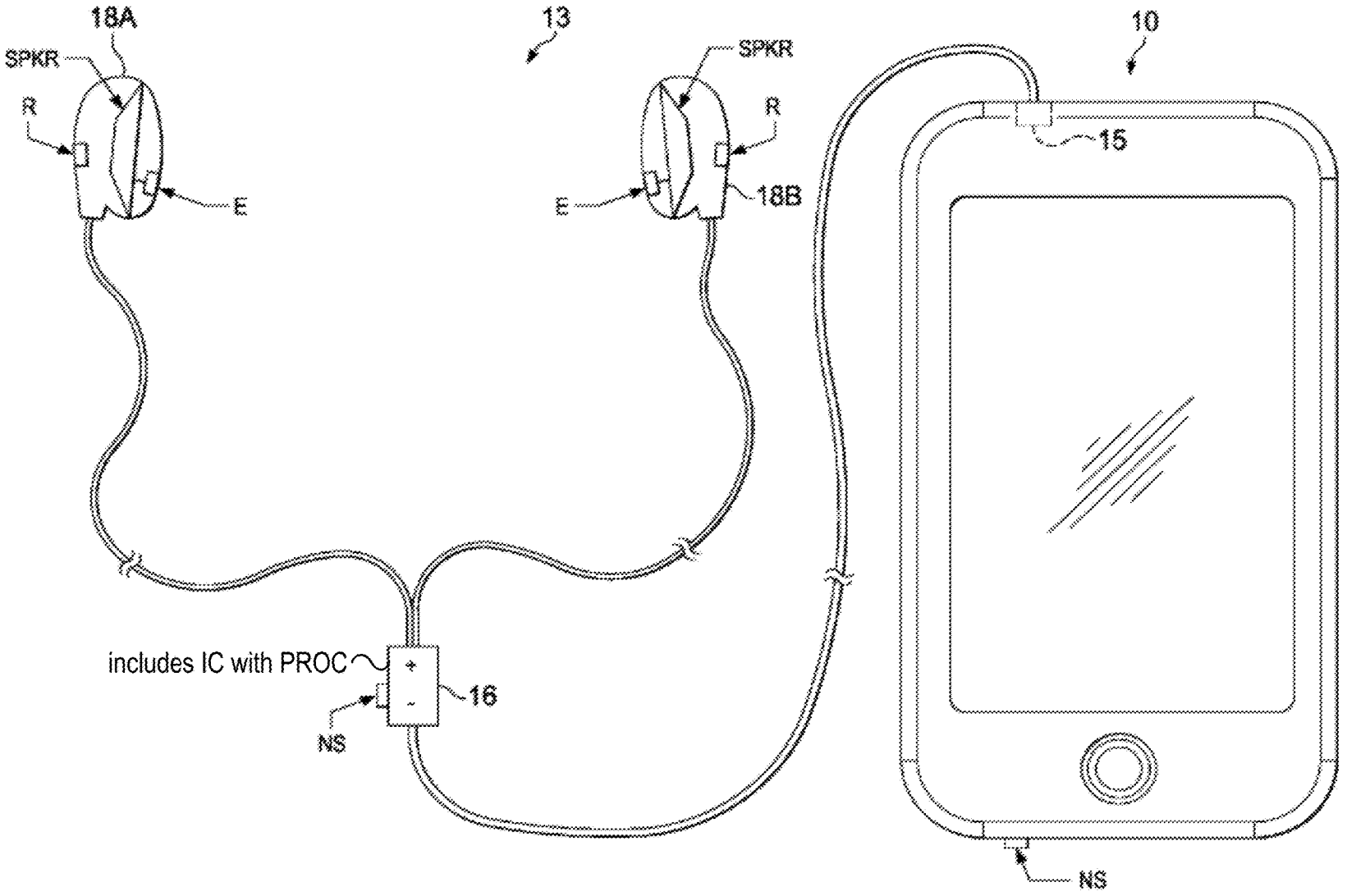
FIG. 1B is an illustration of an example wireless telephone with a headset assembly coupled thereto, in accordance with embodiments of the present disclosure.

Referring now to FIG. 1B, wireless telephone 10 is depicted having a headset assembly 13 coupled to it via audio port 15. Audio port 15 may be communicatively coupled to RF integrated circuit 12 and/or CODEC IC 20, thus permitting communication between components of headset assembly 13 and one or more of RF integrated circuit 12 and/or CODEC IC 20 (e.g., of FIG. 1A). In other embodiments, the headset assembly 13 may connect wirelessly to the wireless telephone 10, e.g., via Bluetooth or other short-range wireless technology. As shown in FIG. 1B, headset assembly 13 may include a combox 16, a left headphone 18A, and a right headphone 18B. As used in this disclosure, the term "headset" broadly includes any loudspeaker and structure associated therewith that is intended to be mechanically held in place proximate to a listener's ear canal, and includes without limitation earphones, earbuds, and other similar devices. As more specific examples, "headset" may refer but is not limited to intra-concha earphones, supra-concha earphones, and supra-aural earphones.

Combox 16 or another portion of headset assembly 13 may have a near-speech microphone NS to capture near-end speech in addition to or in lieu of near-speech microphone NS of wireless telephone 10. In addition, each headphone 18A, 18B may include a transducer, such as speaker SPKR, that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein.

In other embodiments, headset assembly 13 is an example of an ANC-enabled portable audio device in which techniques in accordance with embodiments of this disclosure may be employed, but it is understood that not all of the elements or configurations embodied in illustrated headset 13, or in the circuits depicted in subsequent illustrations, are required in order to practice the inventions recited in the claims. A CODEC IC having a processing element PROC and non-volatile memory similar to CODEC ID 20 of FIG. 1A or another circuit may be present within headset assembly 13, communicatively coupled to reference microphone R, near-speech microphone NS, and error microphone E, and configured to perform active noise cancellation and calibration and testing of the headset 13 as described herein. In such embodiments, an acoustic path having a transfer function P(z) that extends from the reference microphone R to the error microphone E similar to that described with respect to FIG. 1A may also exist with respect to the headset assembly 13. Additionally in such embodiments, an electro-acoustic path having a transfer function S(z) that represents the response of the audio output circuits of the CODEC IC of the headset assembly 13 and the acoustic/electric transfer function of speaker SPKR including the coupling between speaker SPKR and error microphone E, similar to those described with respect to FIG. 1A, may also exist with respect to the headset assembly 13.

Figure 2:
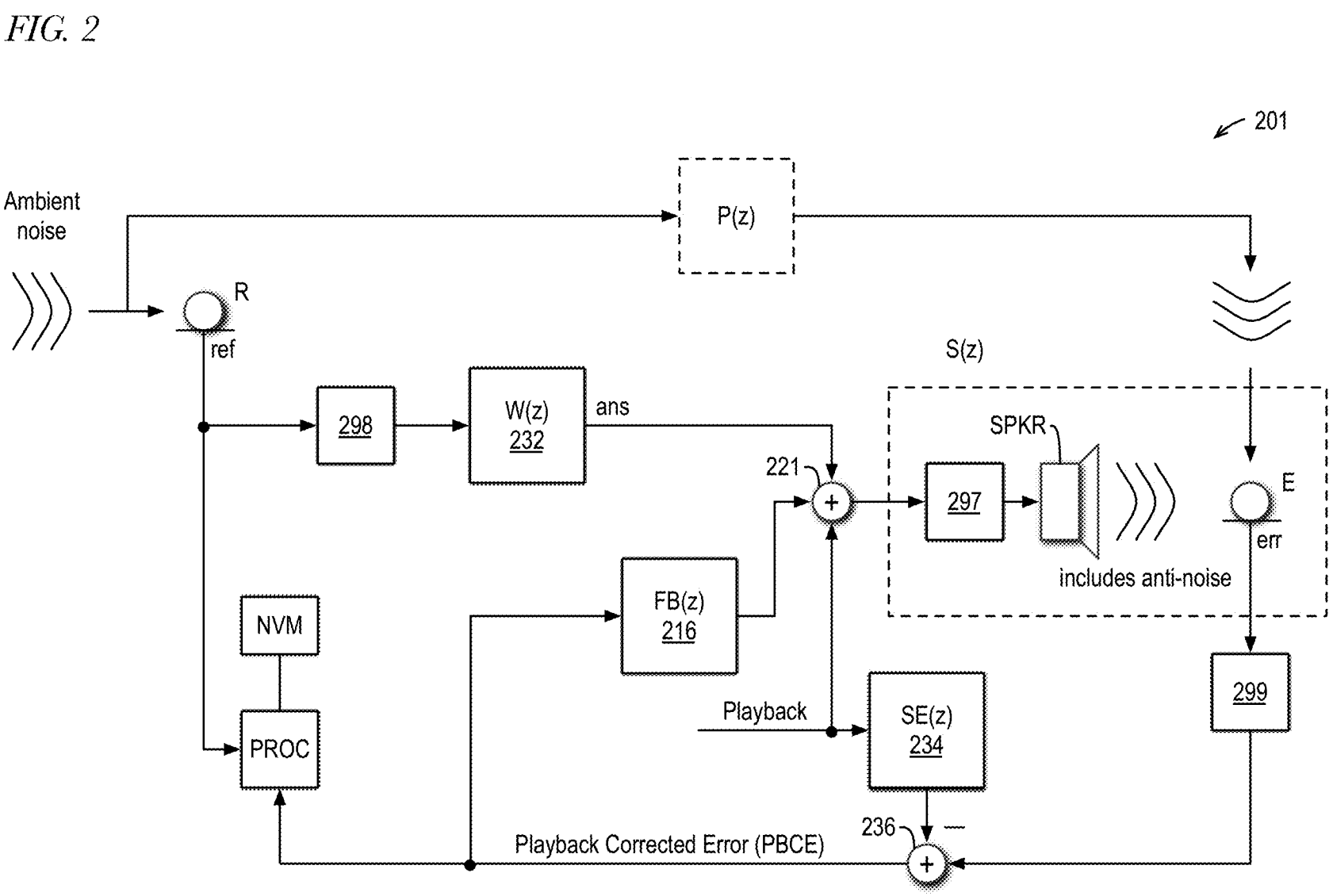
FIG. 2 is an example block diagram of an ANC system that may be included in a portable audio device in accordance with embodiments of the present disclosure.

Referring now to FIG. 2, an example block diagram of a feed forward fixed filter adaptive noise cancellation (ANC)

system 201 that may be included in a portable audio device (e.g., wireless telephone 10 of FIG. 1A or headset 13 of FIG. 1B) in accordance with embodiments of the present disclosure is shown. However, other portable audio devices (e.g., a hearing aid) may include an ANC system that may be calibrated according to embodiments described herein. The ANC system 201 includes a speaker SPKR, a reference microphone R and an error microphone E (e.g., of FIG. 1A or FIG. 1B). Shown in FIG. 2 is an acoustic path P(z) that extends from reference microphone R to error microphone E, as described above with respect to FIGS. 1A and 1B, as well as an electro-acoustic path S(z) that represents the response of the audio output circuits of CODEC IC 20 and the acoustic/electric transfer function of speaker SPKR. The ANC system 201 also includes a processing element PROC (e.g., of FIGS. 1A and 1B), a non-volatile memory (NVM), an anti-noise filter W(z) 232, an estimation filter SE(z) 234 and a feedback filter FB(z) 216.

A combiner 221 combines a playback signal, an anti-noise signal ans generated by anti-noise filter 232, and a feedback signal generated by feedback filter 216 to generate a signal provided to speaker SPKR that responsively generates audio output that may include anti-noise. Although during normal operation of the portable audio device speaker SPKR produces sound (e.g., playback content and anti-noise), speaker SPKR is silent during calibration of the microphones of the portable audio device. However, during calibration of speaker SPKR, although anti-noise is not generated, speaker SPKR plays a calibration sound as playback, as described in more detail below.

Filter 232 receives and filters reference microphone signal ref to generate anti-noise signal ans. Filter 234 estimates the transfer function of path S(z). Filter 234 filters the playback signal to generate a signal that represents the expected playback audio delivered to error microphone E. A second combiner 236 subtracts the output of filter 234 from error microphone signal err to generate a playback corrected error (PBCE) signal. The PBCE signal is equal to error microphone signal err after removal of the playback signal as filtered by filter 234 to represent the expected playback audio delivered to error microphone E. Stated alternatively, the PBCE signal includes the content of the error microphone signal that is not due to the playback signal. Filter 234 may be adapted to generate an estimated signal based on the playback signal that is subtracted from error microphone signal err to generate the PBCE signal. Feedback filter 216 provides a filtered version of the PBCE signal to combiner 221. Filter 232, filter 234 and/or filter 216 may be an adaptive filter or a fixed filter. Although a feed forward fixed filter ANC system is shown in the embodiment of FIG. 2, in other embodiments methods described herein may be used to calibrate a portable audio device having a feedback-only ANC system (e.g., without a reference microphone) and/or an ANC system having one or more adaptive filters.

The ANC system 201 also includes an element 298 that receives (e.g., from processing element PROC) a calibration value for reference microphone R and applies a gain as indicated by the calibration value to the signal generated by reference microphone R to compensate for a change, or delta, in the sensitivity of reference microphone R from its desired specification. The ANC system 201 also includes an element 299 that receives (e.g., from processing element PROC) a calibration value for error microphone E and applies a gain as indicated by the calibration value to the signal generated by error microphone E to compensate for a change, or delta, in the sensitivity of error microphone E from its desired specification. The ANC system 201 also includes an element 297 that receives (e.g., from processing element PROC) a calibration value for speaker SPKR and applies a gain as indicated by the calibration value to the signal provided to speaker SPKR to compensate for a change, or delta, in the sensitivity of speaker SPKR from its desired specification. As described in more detail below, the processing element PROC may store calibration values for the microphones and speakers of the portable audio device in the non-volatile memory NVM and subsequently read the calibration values from the non-volatile memory NVM and apply them to the microphones and speakers via elements 297/298/299, which may enable the ANC system to accomplish greater noise cancellation, as well as improved audio fidelity. Furthermore, according to some embodiments, the processing element PROC may determine calibration values for the microphones and speakers of the portable audio device in a self-calibrating fashion. Although not shown in FIG. 2, the ANC system 201 may also include other microphones, such as near speech microphone NS of FIG. 1A or 1B, for which calibration values are also obtained, stored in non-volatile memory NVM and subsequently applied.

The example embodiment ANC system 201 of FIG. 2 will now be used to describe problems associated with an ANC system that may be solved by portable audio device calibration and test embodiments described herein. Assume in the ANC system 201 that P(z)=1.0 times the ambient noise, W(z)=−1.0 times the ambient noise signal generated by reference microphone R, and S(z)=1.0 times the output signal of combiner 221. As ambient noise comes in, the ambient noise at error microphone E is 1.0 times the ambient noise at reference microphone R, and the anti-noise generated by speaker SPKR is −1.0 times the ambient noise. As a result, error microphone E sees 0.0 times the ambient noise, which may be referred to as infinite cancellation.

As described above, it may be difficult to consistently manufacture the microphones and/or speakers of a portable audio device with the sensitivity targeted by the manufacturer. Assume the sensitivity of reference microphone R increases by 1 decibel (dB). The anti-noise generated by speaker SPKR will now be −1.12 times the ambient noise, and the residual noise seen by error microphone is −0.12 times the ambient noise. Thus, the residual noise is 18.27 dB lower than the ambient noise, instead of experiencing infinite cancellation. Thus, it may be observed that sensitivity changes of the microphones and/or speaker of the portable audio device may limit the amount of noise cancellation the ANC system may perform.

More specifically, the maximum cancellation achievable by the ANC system may be described in equation (1).

$$\text{Max cancellation}=\text{lin2 dB}(1-\text{dB2lin}(\text{delta}S)) \quad (1)$$

where lin2 dB is an operation that converts a linear value to decibels, dB2lin is an operation that converts a decibel value to a linear value, and deltaS is the change in sensitivity of the microphone or speaker in dB. Absolute sensitivity of the microphone or speaker is required in order to achieve infinite noise cancellation by the ANC system. To illustrate by example, a well-sealed ANC headset may achieve ~35 dB of cancellation with fixed filters. In such case, the gain of the microphone needs to be trimmed, or calibrated, to 0.2 dB accuracy.

Figure 3:
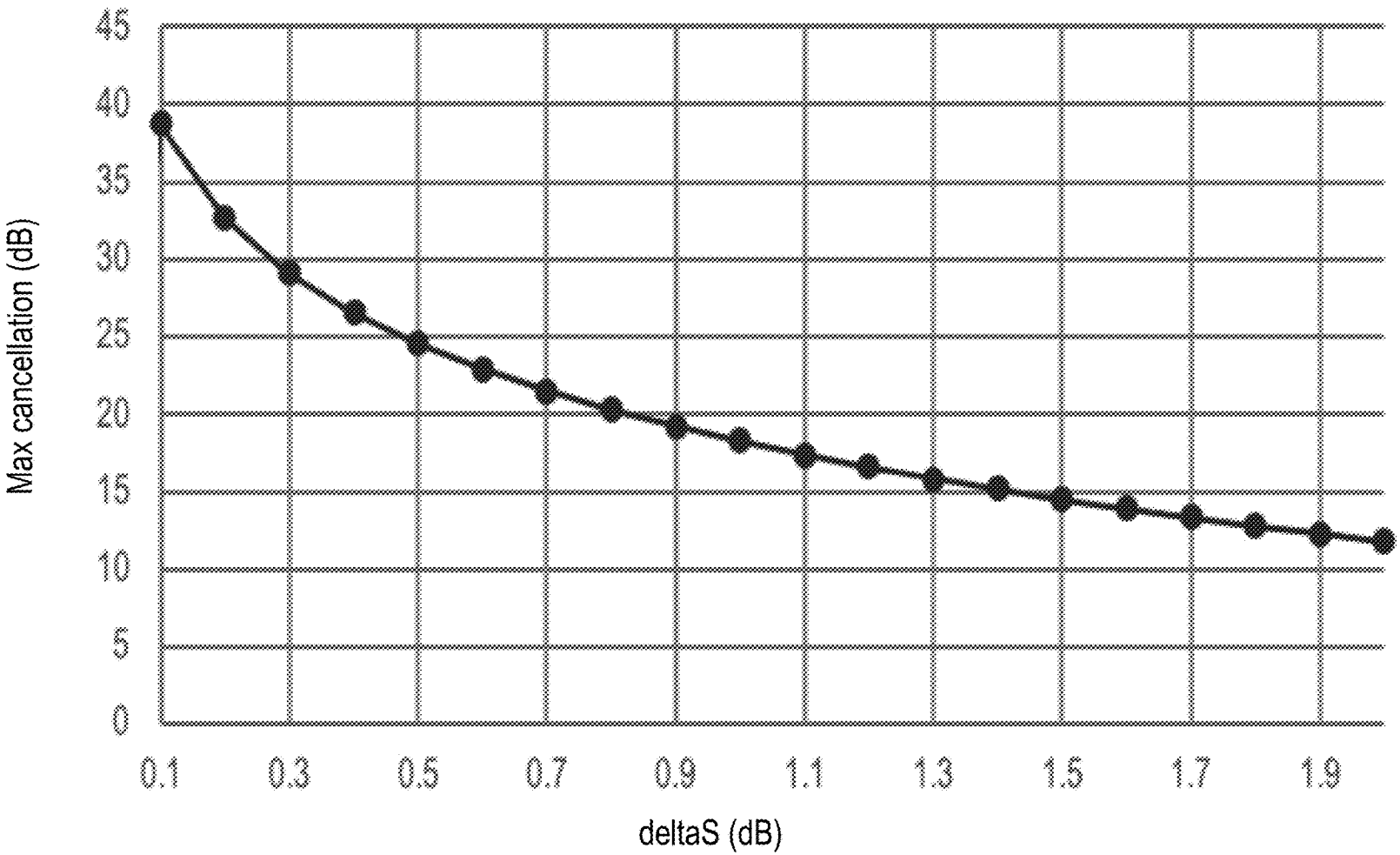
FIG. 3 is a graph illustrating maximum noise cancellation versus change in component sensitivity in accordance with embodiments of the present disclosure.

Referring now to FIG. 3, a graph illustrating maximum noise cancellation versus change in component sensitivity in accordance with embodiments of the present disclosure is shown. Change in sensitivity measured in dB is represented in the graph on the horizontal axis. Values of sensitivity change range between 0.1 and 2.0 dB in the graph. Maximum ANC cancellation measured in dB is represented in the graph on the vertical axis. Values of maximum cancellation range between approximately 39 dB at 0.1 sensitivity change and approximately 12 dB at 2.0 sensitivity change in the graph and the maximum cancellation values decrease in an approximately exponential fashion. As may be observed from FIG. 3, a reduction in the sensitivity change, e.g., through calibration, may accordingly increase the amount of noise cancellation achievable by the ANC system.

Figure 4:
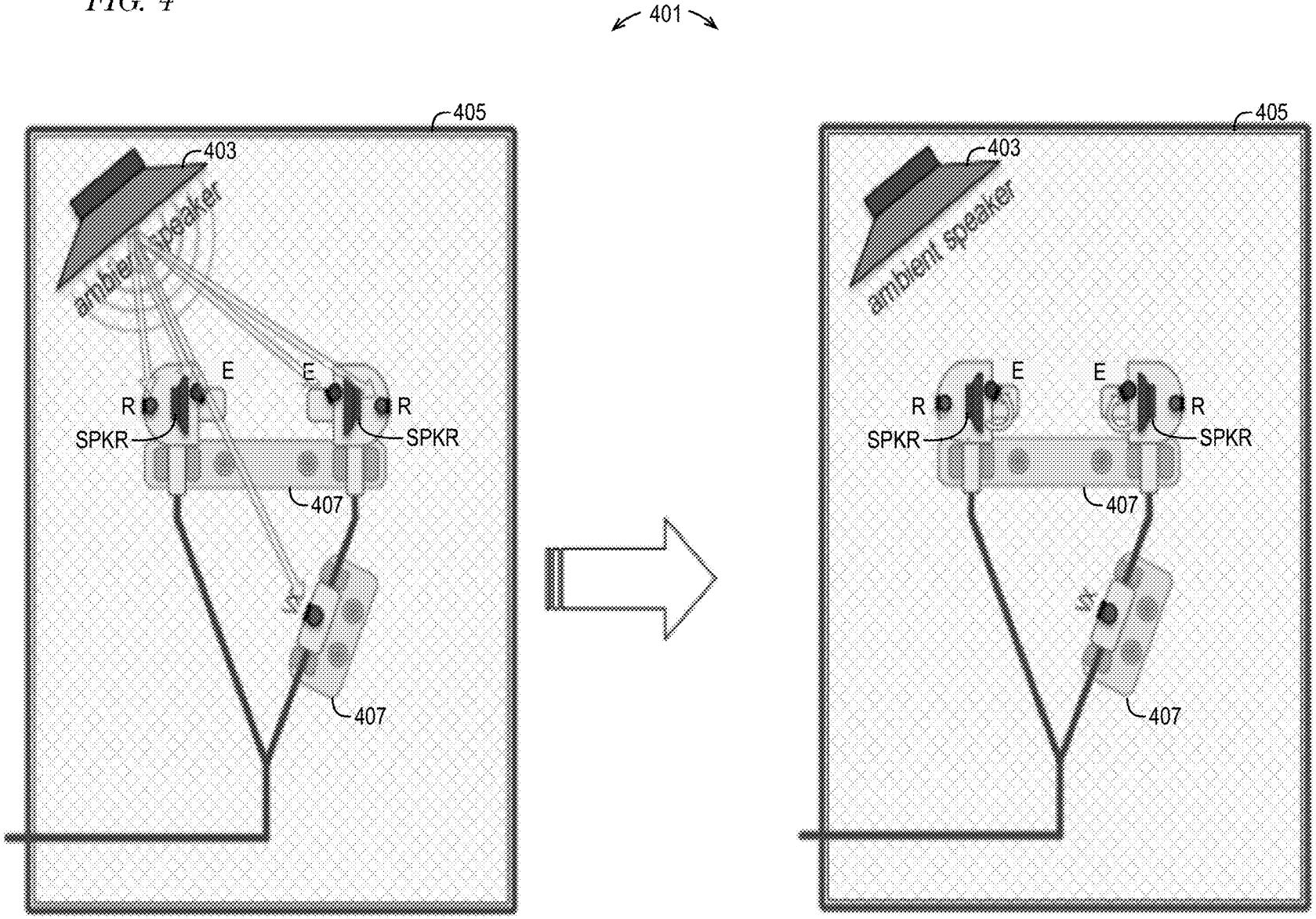
FIG. 4 is a diagram illustrating a test station and method for calibrating and testing an ANC-enabled portable audio device in accordance with embodiments of the present disclosure.

Referring now to FIG. 4, a diagram illustrating a test station 401 and method for calibrating and testing an ANC-enabled portable audio device as a solution for component tolerances and assembly issues in accordance with embodiments of the present disclosure is shown. The ANC-enabled portable audio device (e.g., wireless telephone 10 of FIG. 1A or headset 13 of FIG. 1B) is distinct from components of a test station used to calibrate the portable audio device. That is, the test station may also include audio components (e.g., microphones and a speaker), but the audio components of the test station are not part of the portable audio device that is being calibrated. The test station 401 includes an isolation test chamber 405 that contains an ambient speaker 403 and a device holder 407. The ambient speaker 403 may be driven by a controller (not shown) of the test station 401, e.g., a programmable computer. The controller is also in communication with the ANC-enabled portable audio device to transfer data and commands between them, e.g., via a cable (e.g., USB) or wirelessly (e.g., via Bluetooth). Examples of the data transferred between the test station 401 and the ANC-enabled portable audio device may include predetermined parameters used to calibrate and test the ANC-enabled portable audio device, such as predetermined audio signal levels and tolerances, some of which are described in more detail below. In the example of FIG. 4, the ANC-enabled portable audio device is a headset (e.g., headset 13 of FIG. 1B), and calibration will be described with reference to a headset having a near speech (or voice) microphone NS (e.g., near speech microphone NS of FIG. 1B) and in each earphone a speaker SPKR (e.g., speakers SPKR of FIG. 1B), a reference microphone R (e.g., reference microphones R of FIG. 1B), and an error microphone E (e.g., error microphones E of FIG. 1B). However, the ANC-enabled portable audio device may also be of other types, such as a wireless handset (e.g., wireless phone 10 of FIG. 1A), hearing aid, or the like.

First, the ANC-enabled headset (or handset) is attached to the device holder 407 in the isolation test chamber 405 (or somewhere quiet), e.g., in a free field such that all of the headset/handset microphones are within the same acoustic field, or acoustic space and without acoustic interference with respect to sounds played by the ambient speaker 403. Exposing all the microphones of the headset/handset to a continuously-played calibration sound played by the ambient speaker 403 may provide advantages over a conventional calibration system in which the headphones/handset are inserted into or placed next to an ear simulator of the test station, e.g., an acoustic coupler, artificial ear, or head and torso simulator. The ear simulator of a conventional system includes its own microphones, which are not part of the portable audio device, that operate to imitate ears of a user. The ear simulator of the conventional system described here effectively prevents the error microphone from receiving full sounds from the speaker of the conventional test system. In contrast, in the embodiment of FIG. 4, the error microphone receives or hears the output of the ambient speaker 403 because it does not include an ear simulator (e.g., of a conventional test station) that prevents the error microphone from receiving or hearing sound played by the ambient speaker 403.

Next, the ambient speaker 403 continuously plays a calibration sound in the test chamber 405. The headset automatically measures the level on each microphone, e.g., E/R/NS, in response to the continuously-played calibration sound. The portable audio device may include multiple detectors to detect the levels of all its microphones concurrently. The headset (e.g., processing element PROC of FIG. 2) then computes calibration values for each microphone E/R/NS of all the microphones and stores them in non-volatile memory (e.g., non-volatile memory NVM of FIG. 2). The calibration sound from the ambient speaker 403 is then stopped. Then, as shown, the headset plays a calibration sound from speaker SPKR of the headset (or handset). In an embodiment in which the portable audio device has two speakers, the calibration sound may be played by speaker SPKR of a first headphone (e.g., left) after the calibration sound played by the ambient speaker 403 settles, then the calibration sound may be played by speaker SPKR of the second headphone (e.g., right) after the calibration sound played by the first headphone has settled. A calibration value for each speaker SPKR is computed from the now calibrated microphones and is stored in non-volatile memory NVM. An alternate embodiment is described below with respect to FIG. 6 in which a processing element of the test station, rather than the headset, performs the calibration value computation.

Additionally, the portable audio device may self-test its ANC system. At the same time, microphone calibration is performed, the frequency response of each microphone may be checked. For example, a DSP of the headset (e.g., processing element PROC) may take the Fast Fourier Transform (FFT) of the signal generated by each microphone and compare the FFT result to a predetermined mask to make a determination whether the headset passes or fails. In one embodiment, comparison is performed by the headset itself, e.g., by processing element PROC. Speaker SPKR may be tested in a similar manner. That is, speaker SPKR plays a calibration sound, and the FFT of each microphone signal is compared to a predetermined mask to determine whether the response of speaker SPKR is acceptable or that there is an internal acoustic leakage path that would cause a problem and be a reason to fail the headset.

As may be observed from FIG. 4, according to embodiments described herein, advantageously the test station requires only a calibrated speaker to calibrate the portable audio device but does not require its own microphone or ear simulator in order to calibrate the portable audio device. The absence of test station microphones may reduce the complexity and expense of the test station, as well as eliminate the need to calibrate additional microphones, i.e., the test station microphones. Additionally, a 2-phase approach is embodied in which all the portable audio device microphones are calibrated at the same time, i.e., during the same instance of a calibration sound continuously played by the calibrated test station speaker, and then the portable audio device speaker is calibrated using the now calibrated error microphone of the portable audio device. The 2-phase approach may advantageously save time over a conventional 3-phase approach in which the device microphones other than the error microphone are calibrated using the calibrated test station speaker, then the device speaker is calibrated using a calibrated microphone of the test station, then the error microphone is calibrated using the now calibrated device speaker (alternatively, in the conventional approach the other microphones may be calibrated after the error microphone is calibrated). Furthermore, in embodiments in which the processing element of the portable audio device performs the calibration value computation, the complexity of the test station may also be reduced.

In order to more fully appreciate advantages of the embodiments described above and below, an example of a conventional calibration method will now be described. In one conventional system, for example a system that calibrates earbuds, a test fixture includes two artificial ears, or couplers, into which the two earbuds are inserted. Each artificial ear includes a test microphone. The test microphone must be calibrated so that its sensitivity is known. When a test tone is generated to perform a calibration determination, a settling time is incurred to allow the test tone to settle before another test tone can be generated to perform another calibration determination. Making a calibration determination for one or more microphones or a speaker using a test tone instance may be referred to as a phase, and phases are separated by a settling time. Thus, phases cannot be performed simultaneously, but must instead be performed sequentially. The conventional method involves at least three phases: (1) calibrate the microphones other than the error microphone using the known sensitivity of the external speaker of the test station; (2) calibrate the internal speaker using the known sensitivity of the test station microphone; and (3) calibrate the error microphone using the known sensitivity of the now calibrated internal speaker. In the conventional method, the error microphone is calibrated in a separate phase from the other microphones, i.e., the error microphone is calibrated in response to a separate test tone (played by the internal speaker) from the test tone used to calibrate the other microphones (played by the external speaker).

In contrast, embodiments described herein require only two phases: (1) calibrate all microphones in response to an instance of a calibration sound played continuously by the external speaker of the test station whose sensitivity is known; and (2) calibrate the internal speaker using the known sensitivity of the now calibrated microphones (e.g., error microphone). Thus, the described embodiments incur fewer phases and fewer associated settling times such that described embodiments may calibrate the portable audio device faster than the conventional method. In the case of an ANC-enabled portable audio device having multiple speakers (e.g., headset with two speakers), a third phase may be incurred (i.e., an additional settling time is incurred), e.g., the right speaker plays its calibration sound in order to calibrate the right speaker and then the left speaker plays its calibration sound in order to calibrate the left speaker. Advantageously, the embodiment also requires fewer phases than a conventional system incurs since the conventional system incurs four phases to calibrate a device with two speakers.

Other advantages may also be appreciated. First, no artificial ear or other form of ear simulator is needed, e.g., coupler and Drum Reference Point (DRP) microphones, which are typically expensive components. Furthermore, it may be difficult to obtain a consistent fit on an artificial ear or other ear simulator, which may affect the accuracy of the calibration; whereas, described embodiments avoid the potential inaccuracy associated with an ear simulator. Second, complexity of communication between the portable audio device and the test station may be reduced, and computation requirements by the test station may be reduced. The test station downloads the test program and pass/fail masks to the portable audio device. The test station tells the portable audio device when to start the microphone calibration. The portable audio device signals when speaker calibration and self-test is complete and whether the portable audio device passes or fails. Third, there is no need for a final ANC test, which may be time-consuming. If all microphones, speakers and associated paths are good, then the ANC system may be assumed to be good. Fourth, as mentioned above, the time and effort to calibrate a test station microphone is no longer required since no test station microphone is needed. Fifth, in some embodiments the processing element of the portable audio device analyzes the measured responses of the portable audio device microphones and computes their calibration values, which alleviates the need for the test station to include audio analysis equipment to perform this function.

Figure 5A:
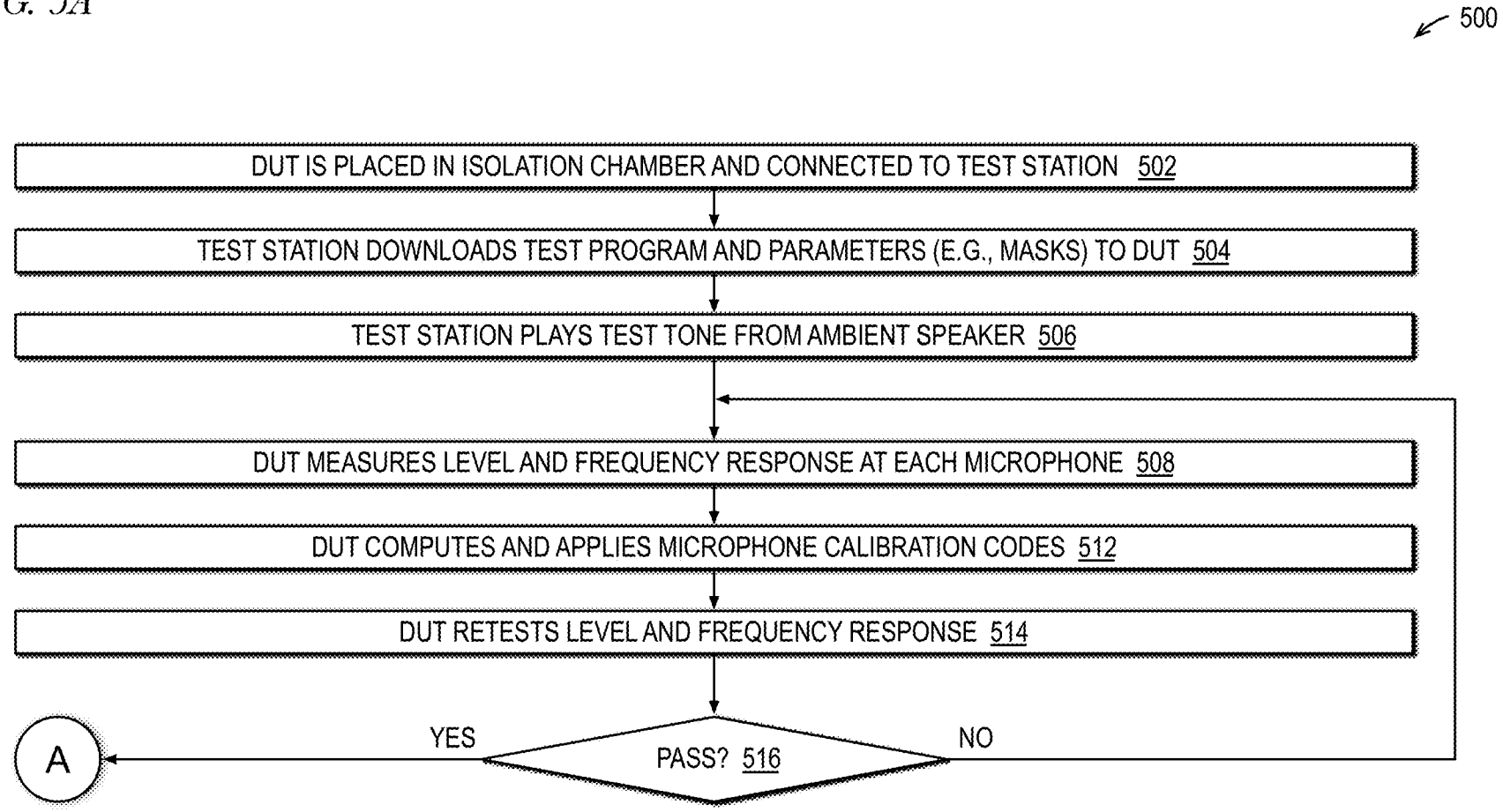
FIGS. 5A and 5B, referred to collectively as FIG. 5, are a flowchart illustrating calibration of an ANC-enabled portable audio device in accordance with embodiments of the present disclosure.
Figure 5B:
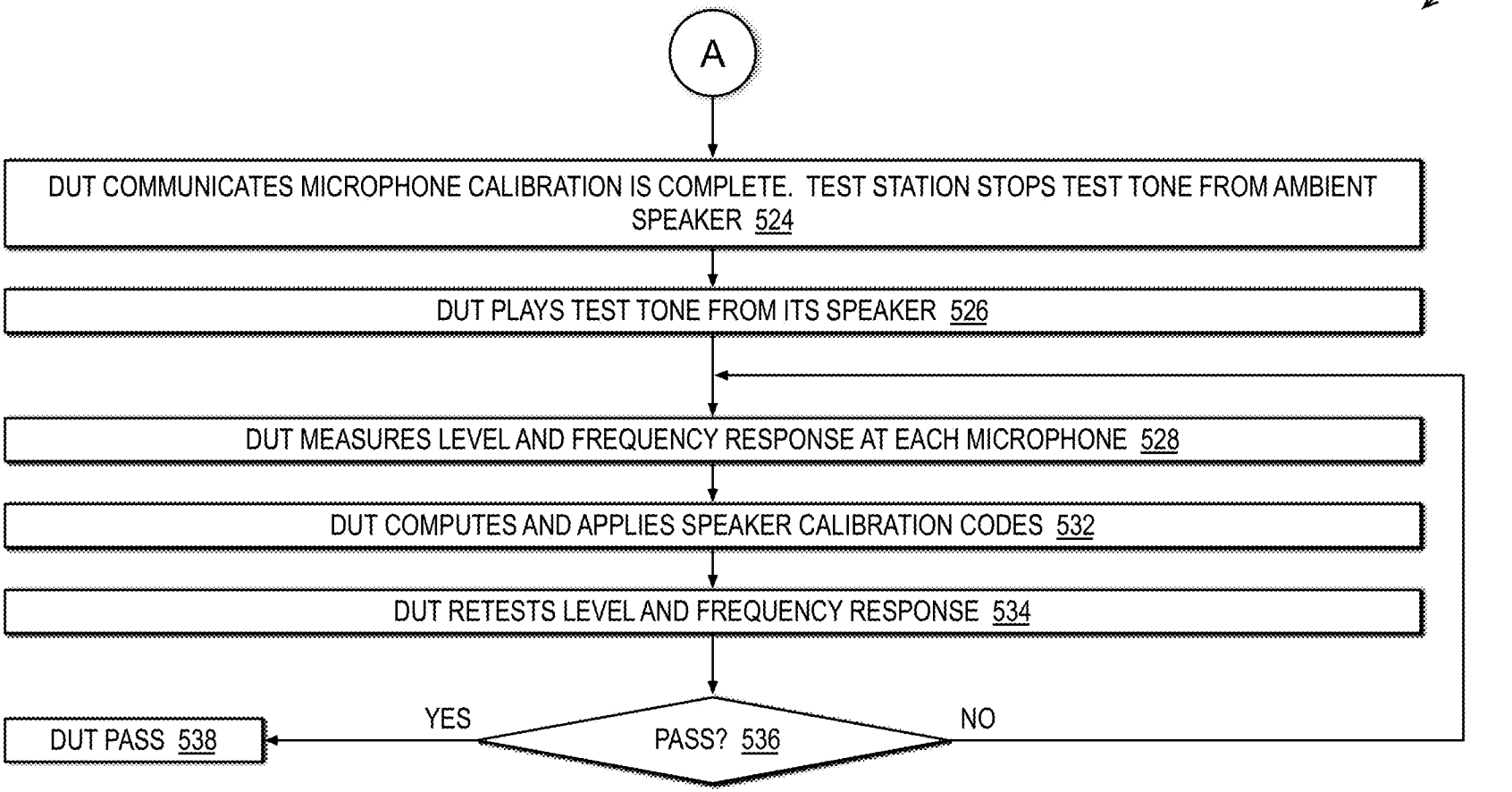

Referring now to FIG. 5 (collectively FIGS. 5A and 5B), a flowchart illustrating calibration of an ANC-enabled portable audio device (e.g., wireless telephone 10 of FIG. 1A or headset 13 of FIG. 1B having an ANC system 201 of FIG. 2) in accordance with embodiments of the present disclosure is shown. The ANC-enabled portable audio device is referred to as the device under test (DUT) in FIG. 5. During calibration of the portable audio device, the ANC system of the portable audio device is turned off such that anti-noise is not generated (e.g., by anti-noise filter 232 of FIG. 2) and no feedback signal is generated (e.g., by feedback filter 216 of FIG. 2). Instead, only a calibration sound (e.g., a tone with a known-level) is generated by ambient speaker 403 of the test station during calibration of the microphones of the portable audio device, e.g., at block 506 described below. Furthermore, during calibration of speaker SPKR of the portable audio device, only playback audio (a calibration sound) is generated by speaker SPKR, e.g., at block 526 described below (and the test station ambient speaker 403 is silent). Operation begins at block 502.

At block 502, the DUT is placed in an isolation chamber (e.g., test chamber 405 of FIG. 4) and connected to a test station (e.g., to device holder 407 of test station 401 of FIG. 4). In one embodiment, the DUT is connected to the test station such that all the DUT microphones are in a free field, i.e., in the same acoustic space and without acoustic interference. In other embodiments, the DUT is connected to the test station such that all microphones of the DUT receive measurable sound from an ambient speaker of the test station (e.g., at block 506 below), although different microphones of the DUT may receive different levels of the calibration sound played by the test station speaker, e.g., reference microphone R may receive a 3.0 dB calibration sound, and error microphone E may receive a 2.7 dB calibration sound; however, for each instance of a DUT being calibrated, reference microphone R repeatably receives a 3.0 dB calibration sound, and error microphone E repeatably receives a 2.7 dB calibration sound from the ambient speaker. The operation proceeds to block 504.

At block 504, the test station (e.g., the controller of test station 401) downloads to the DUT parameters needed to calibrate and test the ANC system of the portable audio device. In one embodiment, the test station also downloads to the DUT a test program for execution by processing element PROC of the DUT to perform calibration of its ANC system. In an alternate embodiment, the test program and/or the parameters may be resident on the portable audio device (e.g., stored in a non-volatile memory) for execution and use by processing element PROC rather than being downloaded from the test station. The operation proceeds to block 506.

At block 506, the test station plays a test tone or other calibration sound from its ambient speaker (e.g., ambient speaker 403 of FIG. 4). Advantageously, all the microphones (e.g., R/E/NS of FIG. 2) of the portable audio device are able to receive or hear the calibration sound played by the ambient speaker 403 by virtue of their placement at block 502, e.g., without obstruction by an ear simulator. The calibration sound is played continuously (e.g., until stopped at block 524) which advantageously enables all the microphones of the DUT to be calibrated in response to the continuously-played calibration sound (e.g., at block 512) without incurring a settling time. Information about the calibration sound (e.g., test tone frequency composition and level) may be downloaded at block 504. The operation proceeds to block 508.

At block 508, the DUT (e.g., processing element PROC) measures the level and frequency response at each of its microphones. Advantageously, the level and frequency response of all the DUT microphones may be measured by processing element PROC in response to the calibration sound played at block 506 by the ambient speaker 403, e.g., because all of the microphones are in a free field. The operation proceeds to block 512.

At block 512, the DUT (e.g., processing element PROC) computes a calibration value for each of its microphones using the corresponding levels and/or frequency responses measured at block 508. Preferably, for each microphone, processing element PROC compares the measured level and/or frequency response with a corresponding predetermined level and/or frequency response for the microphone (e.g., a level and/or frequency response downloaded at block 504) and determines the calibration value based on the comparison. Additionally, processing element PROC stores the computed calibration values to non-volatile memory (e.g., non-volatile memory NVM of FIG. 2). Furthermore, for each of the microphones, processing element PROC applies the calibration values to the microphone (e.g., by reading its calibration value from non-volatile memory NVM and writing it to the appropriate element 298 or 299 of FIG. 2) to cause the microphone to effectively exhibit the desired sensitivity. The operation proceeds to block 514.

At block 514, the DUT retests the level and frequency response of each of the microphones of the portable audio device. That is, the operations at blocks 508 through 512 are repeated. The retest may be performed as a double-check in case an aberration occurred during the initial instance of blocks 508 through 512, e.g., test personnel accidentally bumped the test chamber or device holder 407 or portable audio device, or an unusually loud sound happened to be made outside the test chamber at the moment of performance of the initial instance of blocks 508 through 512. In one embodiment, if the results of the first two instances of blocks 508 through 512 differ widely, a third instance may be performed. The operation proceeds to decision block 516.

At decision block 516, if the DUT fails, the operation returns to block 508; otherwise, the operation proceeds to block 524. In one embodiment, if the DUT fails at block 516 three times, the DUT is considered a failed unit and reports the failure to the test station rather than returning operation to block 508.

At block 524, the DUT communicates to the test station that the calibration of all its microphones is complete. In response, the test station stops playing the calibration sound from the ambient speaker 403 that it began at block 506. At this point in the process, the computed calibration values have been applied to each of the microphones per block 512 such that each of the microphones is calibrated. The operation proceeds to block 526.

At block 526, the DUT plays a test tone or other calibration sound from its own speaker SPKR, e.g., via the playback signal of FIG. 2. Information about the calibration sound (e.g., test tone frequency composition and level) to be played by speaker SPKR may be downloaded at block 504. Advantageously, error microphone E has been calibrated at this point in the process so it may be used to accurately measure the acoustic output of speaker SPKR. The operation proceeds to block 528.

At block 528, the DUT (e.g., processing element PROC) measures the level and frequency response at each microphone. Advantageously, because the calibration value has been applied to error microphone E at block 512, microphone E's measured level and frequency response in response to the calibration sound played at block 526 by speaker SPKR of the portable audio device may be used to compute a calibration value for speaker SPKR (e.g., at block 532 below). Additionally, measuring the levels of other microphones may be used to test the portable audio device for defects. For example, measuring the level and/or frequency response of reference microphone R may be used to determine if there are defective internal seals of the portable audio device that cause the sound from speaker SPKR to excessively leak to reference microphone R. The operation proceeds to block 532.

At block 532, the DUT (e.g., processing element PROC) computes a calibration value for speaker SPKR using the level and/or frequency response measured at block 528. Preferably, processing element PROC compares the measured level and/or frequency response with a corresponding predetermined level and/or frequency response for speaker SPKR (e.g., a level and/or frequency response downloaded at block 504) and determines the calibration value based on the comparison. Because the portable audio device is placed in a very quiet location (e.g., test chamber 405 of FIG. 4) such that ambient audio is minimal, the signal generated by error microphone E is indicative of the acoustic output of speaker SPKR, which enables the processing element PROC to compare the error microphone output signal with a known level to compute a calibration value for speaker SPKR. Additionally, processing element PROC stores the computed calibration value to non-volatile memory (e.g., non-volatile memory NVM of FIG. 2). Furthermore, processing element PROC applies the calibration value to speaker SPKR (e.g., by reading its calibration value from non-volatile memory NVM and writing it to element 297 of FIG. 2) to cause speaker SPKR to effectively exhibit the desired sensitivity. The operation proceeds to block 534.

At block 534, the DUT retests the level and frequency response of speaker SPKR. That is, the operations at blocks 528 through 532 are repeated. The retest may be performed as a double-check in case an aberration occurred during the initial instance of blocks 528 through 532, e.g., test personnel accidentally bumped the test chamber or device holder 407 or portable audio device, or an unusually loud sound happened to be made outside the test chamber at the moment of performance of the initial instance of blocks 528 through 532. In one embodiment, if the results of the first two instances of blocks 528 through 532 differ widely, a third instance may be performed. If the DUT is a portable audio device with two speakers SPKR (e.g., right and left earphones), then the operations at blocks 528 through 534 may be performed separately for each speaker SPKR. The operation proceeds to decision block 536.

At decision block 536, if the DUT fails, the operation returns to block 528; otherwise, the operation proceeds to block 538. In one embodiment, if the DUT fails at block 536 three times, the DUT is considered a failed unit and reports the failure to the test station rather than returning operation to block 528.

At block 538, the DUT reports to the test station that it passed.

Figure 6A:
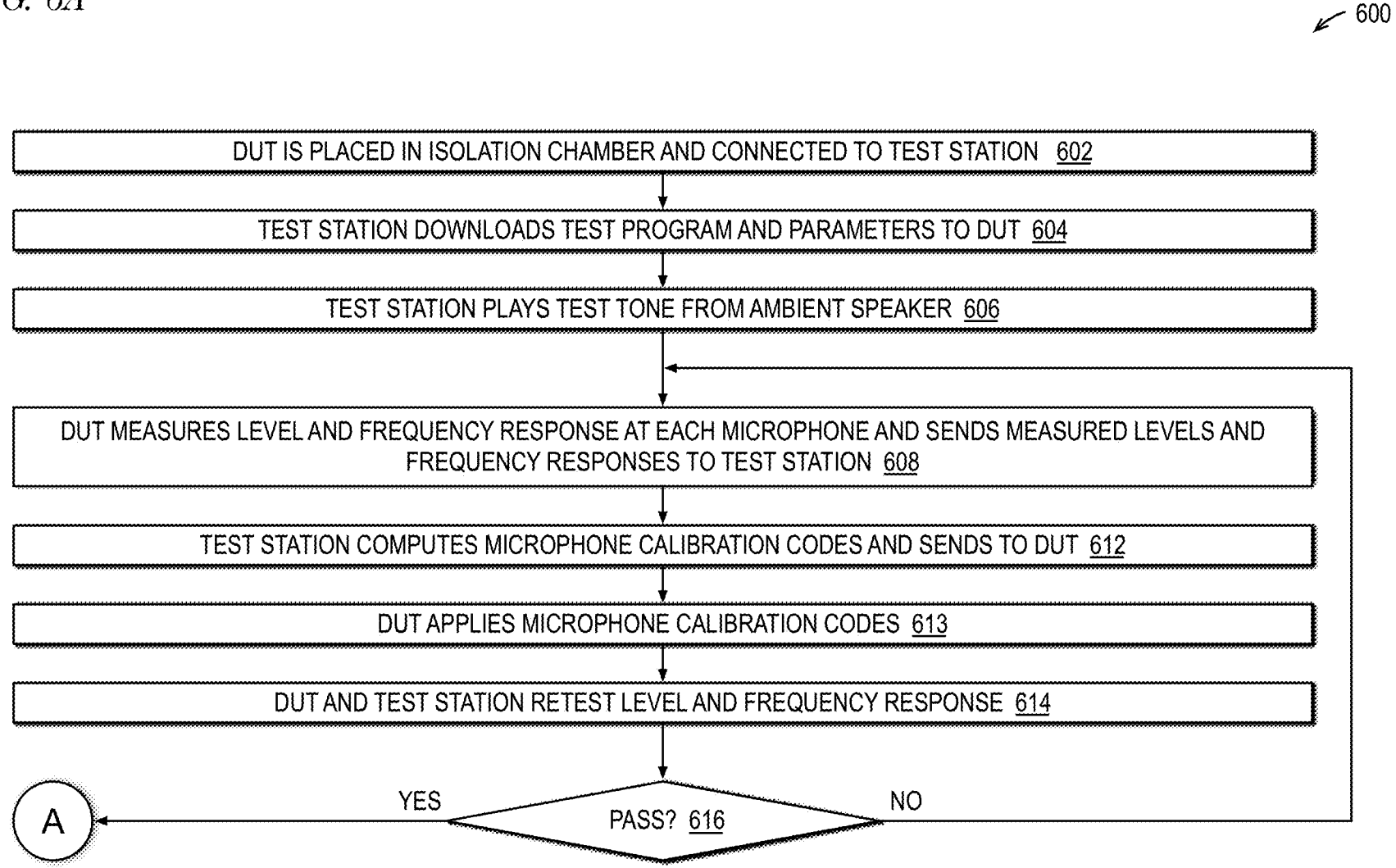
FIGS. 6A and 6B, referred to collectively as FIG. 6, are a flowchart illustrating calibration of an ANC-enabled portable audio device in accordance with alternate embodiments of the present disclosure.
Figure 6B:
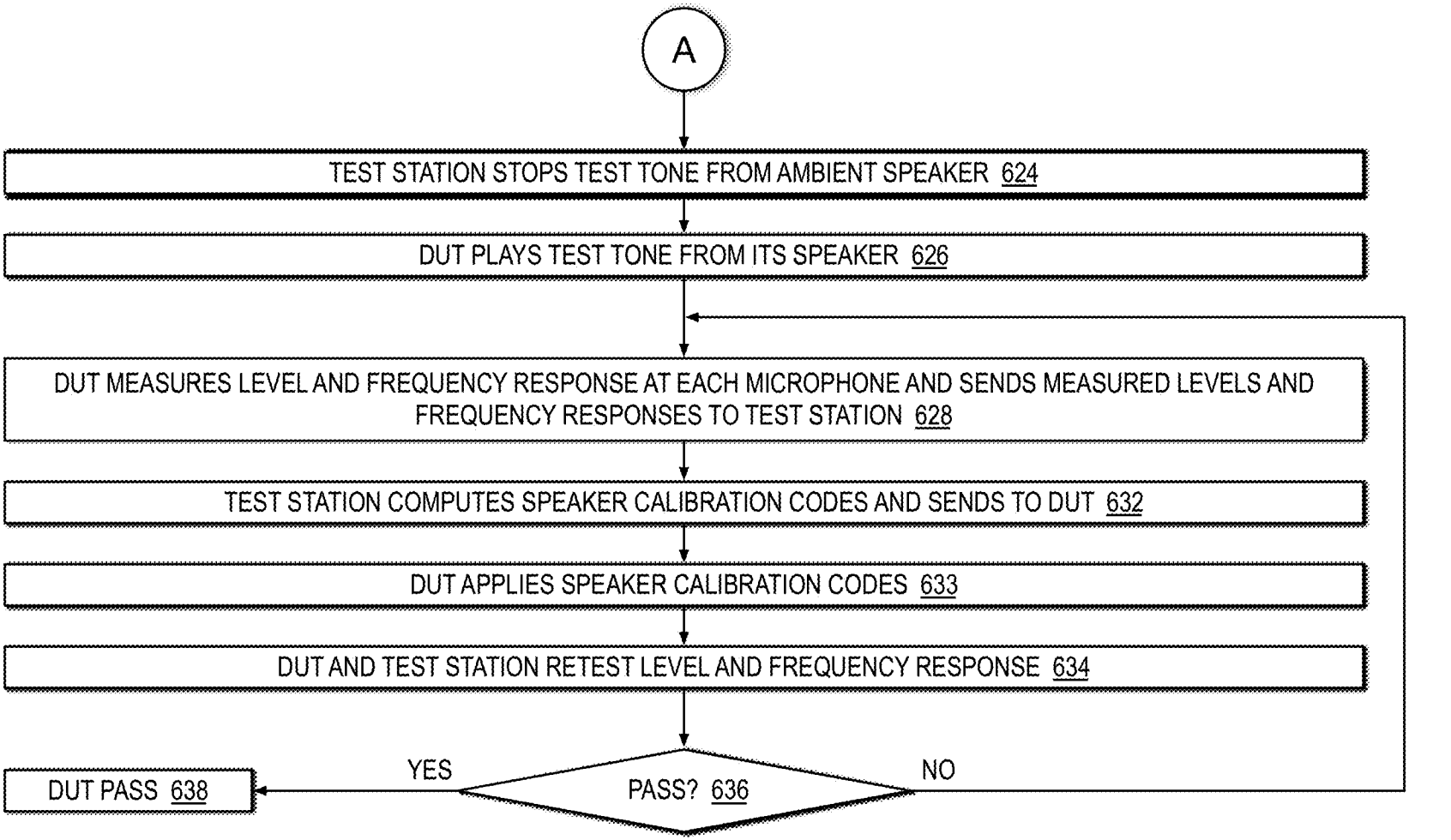

Referring now to FIG. 6 (collectively FIGS. 6A and 6B), a flowchart illustrating calibration of an ANC-enabled portable audio device (e.g., wireless telephone 10 of FIG. 1A or headset 13 of FIG. 1B having an ANC system 201 of FIG. 2) in accordance with alternate embodiments of the present disclosure is shown. The flowchart of FIG. 6 is similar in many respects to the flowchart of FIG. 5. However, in the embodiment of FIG. 6, the computation of the calibration values is performed by the test station (e.g., the controller of test station 401) rather than the processing element PROC of the ANC-enabled portable audio device. Operation begins at block 602.

At block 602, the DUT is placed in an isolation chamber (e.g., test chamber 405 of FIG. 4) and connected to a test station (e.g., to device holder 407 of test station 401 of FIG. 4). In one embodiment, the DUT is connected to the test station such that all the DUT microphones are in a free field, i.e., in the same acoustic space and without acoustic interference. In other embodiments, the DUT is connected to the test station such that all microphones of the DUT receive measurable sound from an ambient speaker of the test station (e.g., at block 606 below), although different microphones of the DUT may receive different levels of the calibration sound played by the test station speaker, e.g., reference microphone R may receive a 3.0 dB calibration sound, and error microphone E may receive a 2.7 dB calibration sound; however, for each instance of a DUT being calibrated, reference microphone R repeatably receives a 3.0 dB calibration sound, and error microphone E repeatably receives a 2.7 dB calibration sound from the ambient speaker. The operation proceeds to block 604.

At block 604, the test station (e.g., the controller of test station 401) downloads to the DUT calibration parameters and a test program for execution by processing element PROC of the DUT to perform calibration of its ANC system. In an alternate embodiment, the test program may be resident on the portable audio device (e.g., stored in a non-volatile memory) for execution and use by processing element PROC rather than being downloaded from the test station. The operation proceeds to block 606.

At block 606, the test station plays a test tone or other calibration sound from its ambient speaker (e.g., ambient speaker 403 of FIG. 4). Advantageously, all the microphones (e.g., R/E/NS of FIG. 2) of the portable audio device are able to hear the calibration sound played by the ambient speaker 403 by virtue of their placement at block 602, e.g., without obstruction by an ear simulator. The calibration sound is played continuously (e.g., until stopped at block 624) which advantageously enables all the microphones of the DUT to be calibrated in response to the continuously-played calibration sound (e.g., at block 612) without incurring a settling time. The operation proceeds to block 608.

At block 608, the DUT (e.g., processing element PROC) measures the level and frequency response at each of its microphones. Advantageously, the level and frequency response of all the DUT microphones may be measured by processing element PROC in response to the calibration sound played at block 606 by the ambient speaker 403, e.g., because all of the microphones are in a free field. The DUT then sends the measured levels and frequency responses to the test station. The operation proceeds to block 612.

At block 612, the test station (e.g., controller of test station 401) computes a calibration value for each of the DUT microphones using the corresponding levels and/or frequency responses measured by and received from the DUT at block 608. Preferably, for each microphone, the test station compares the measured level and/or frequency response with a corresponding predetermined level and/or frequency response for the microphone and determines the calibration value based on the comparison. The test station then sends the computed calibration values to the DUT. The operation proceeds to block 613.

At block 613, the DUT receives the calibration values, and processing element PROC stores the computed calibration values to non-volatile memory (e.g., non-volatile memory NVM of FIG. 2). Furthermore, for each of the microphones, processing element PROC applies the calibration values to the microphone (e.g., by reading its calibration value from non-volatile memory NVM and writing it to the appropriate element 298 or 299 of FIG. 2) to cause the microphone to effectively exhibit the desired sensitivity. The operation proceeds to block 614.

At block 614, the DUT and test station retest the level and frequency response of each of the microphones of the portable audio device. That is, the operations at blocks 608 through 612 are repeated. The retest may be performed as a double-check in case an aberration occurred during the initial instance of blocks 608 through 612, e.g., test personnel accidentally bumped the test chamber or device holder 407 or portable audio device, or an unusually loud sound happened to be made outside the test chamber at the moment of performance of the initial instance of blocks 608 through 612. In one embodiment, if the results of the first two instances of blocks 608 through 612 differ widely, a third instance may be performed. The operation proceeds to decision block 616.

At decision block 616, if the DUT fails, the operation returns to block 608; otherwise, the operation proceeds to block 624. In one embodiment, if the DUT fails at block 616 three times, the DUT is considered a failed unit and the test station reports the failure rather than returning operation to block 608.

At block 624, the test station stops playing the calibration sound from the ambient speaker 403 that it began at block 606. At this point in the process, the computed calibration values have been applied to each of the microphones per block 612 such that each of the microphones is calibrated. The operation proceeds to block 626.

At block 626, the DUT plays a test tone or other calibration sound from its own speaker SPKR (e.g., in response to a command from the test station), e.g., via the playback signal of FIG. 2. Information about the calibration sound (e.g., test tone frequency composition and level) to be played by speaker SPKR may be downloaded at block 604. Advantageously, error microphone E has been calibrated at this point in the process so it may be used to accurately measure the acoustic output of speaker SPKR. The operation proceeds to block 628.

At block 628, the DUT (e.g., processing element PROC) measures the level and frequency response at each of its microphones. The DUT then sends the measured levels and frequency responses to the test station. Advantageously, because the calibration value has been applied to error microphone E at block 613, microphone E's measured level and frequency response in response to the calibration sound played at block 626 by speaker SPKR of the portable audio device may be used to compute a calibration value for speaker SPKR (e.g., at block 632 below). Additionally, measuring the levels of other microphones may be used to test the portable audio device for defects. For example, measuring the level and/or frequency response of reference microphone R may be used to determine if there are defective internal seals of the portable audio device that cause the sound from speaker SPKR to excessively leak to reference microphone R. The operation proceeds to block 632.

At block 632, the test station (e.g., controller of test station 401) computes a calibration value for speaker SPKR using the level and/or frequency response measured by and received from the DUT at block 628. Preferably, the test station compares the measured level and/or frequency response with a corresponding predetermined level and/or frequency response for speaker SPKR and determines the calibration value based on the comparison. Because the portable audio device is placed in a very quiet location (e.g., test chamber 405 of FIG. 4) such that ambient audio is minimal, the signal generated by error microphone E is indicative of the acoustic output of speaker SPKR, which enables the test station to compare the error microphone output signal with a known level to compute a calibration value for speaker SPKR. The test station then sends the computed calibration codes to the DUT. The operation proceeds to block 633.

At block 633, the DUT receives the calibration value, and processing element PROC stores the computed calibration value to non-volatile memory (e.g., non-volatile memory NVM of FIG. 2). Furthermore, processing element PROC applies the calibration value to speaker SPKR (e.g., by reading its calibration value from non-volatile memory NVM and writing it to element 297 of FIG. 2) to cause speaker SPKR to effectively exhibit the desired sensitivity. The operation proceeds to block 634.

At block 634, the DUT and test station retest the level and frequency response of speaker SPKR. That is, the operations at blocks 628 through 632 are repeated. The retest may be performed as a double-check in case an aberration occurred during the initial instance of blocks 628 through 632, e.g., test personnel accidentally bumped the test chamber or device holder 407 or portable audio device, or an unusually loud sound happened to be made outside the test chamber at the moment of performance of the initial instance of blocks 628 through 632. In one embodiment, if the results of the first two instances of blocks 628 through 632 differ widely, a third instance may be performed. If the DUT is a portable audio device with two speakers SPKR (e.g., right and left earphones), then the operations at blocks 628 through 634 may be performed separately for each speaker SPKR. The operation proceeds to decision block 636.

At decision block 636, if the DUT fails, the operation returns to block 628; otherwise, the operation proceeds to block 638. In one embodiment, if the DUT fails at block 636 three times, the DUT is considered a failed unit and the test unit reports the failure rather than returning operation to block 628.

At block 638, the test station reports that the DUT passed.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, unless otherwise indicated, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure refers to specific embodiments, certain modifications and changes can be made to those embodiments without departing from the scope and coverage of this disclosure. Moreover, any benefits, advantages, or solutions to problems that are described herein with regard to specific embodiments are not intended to be construed as a critical, required, or essential feature or element.

Further embodiments likewise, with the benefit of this disclosure, will be apparent to those having ordinary skill in the art, and such embodiments should be deemed as being encompassed herein. All examples and conditional language recited herein are intended for pedagogical objects to aid the reader in understanding the disclosure and the concepts contributed by the inventor to furthering the art and are construed as being without limitation to such specifically recited examples and conditions.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A method for calibrating an active noise cancellation (ANC)-enabled portable audio device having microphones, comprising:

playing continuously a calibration sound by a calibrated speaker of a test station that is separate from the portable audio device;

for each microphone of all the microphones of the portable audio device:

measuring a level of an audio signal transduced by the microphone in response to the continuously-played calibration sound;

making a comparison of a predetermined level and the measured level; and computing a calibration value for the microphone using the comparison;

wherein said measuring, said making the comparison and said computing the calibration value are performed for all of the microphones of the portable audio device without using a microphone of the test station;

wherein said measuring, said making the comparison and said computing the calibration value are performed for all of the microphones of the portable audio device in response to the continuously-played calibration sound; and wherein said making the comparisons and said computing the calibration values are performed by a processing element of the portable audio device.

2. The method of claim 1, further comprising:

playing a second calibration sound from a speaker of the portable audio device after said playing the first calibration sound;

measuring a second level of a second audio signal transduced by at least one of the microphones in response to the second calibration sound and while the computed calibration value is applied to the at least one of the microphones;

making a second comparison of a second predetermined level and the second measured level; and computing a second calibration value for the speaker of the portable audio device using the second comparison.

3. The method of claim 2, wherein the at least one microphone is located in the portable audio device in proximity to the speaker of the portable audio device for providing a microphone signal indicative of an acoustic output of the speaker of the portable audio device.

4. The method of claim 2, wherein said computing the second calibration value for the speaker is performed absent information from any microphone separate from the portable audio device.

5. The method of claim 2, further comprising:

communicating, by the portable audio device to a test station that comprises the calibrated speaker that is separate from the portable audio device, that the first calibration value has been computed prior to said playing the second calibration sound from the speaker of the portable audio device.

6. The method of claim 1, further comprising:

providing calibration parameters to the portable audio device from a test station separate from the portable audio device for use by the processing element of the portable audio device; and wherein the calibration parameters include one or more of the following:

the predetermined level;

a sensitivity tolerance of the microphones or a speaker of the portable audio device; and frequency masks.

7. The method of claim 1, further comprising:

for each microphone of all the microphones of the portable audio device, by the processing element of the portable audio device:

applying the computed calibration value to the microphone;

testing to determine whether a sensitivity of the calibrated microphone is within a tolerance; and reporting whether the portable audio device passes or fails based on said testing to a test station comprising the calibrated speaker that is separate from the portable audio device.

8. The method of claim 1, wherein said making the comparisons and said computing the calibration values are performed by a processing element of a test station separate from the portable audio device.

9. The method of claim 1, wherein said continuously playing the calibration sound by the calibrated speaker of the test station is performed while all the microphones of the portable audio device are in a free field.

10. An active noise cancellation (ANC)-enabled portable audio device, comprising:

a speaker;

at least one microphone;

a processing element within the ANC-enabled portable audio device programmed to:

measure an audio signal transduced by the at least one microphone in response to a calibration sound;

make a comparison of a predetermined level and a level of the measured audio signal; and compute a calibration value for the at least one microphone using the comparison; and wherein the processing element is further programmed to:

cause the speaker to generate a second calibration sound;

measure a second level of a second audio signal transduced by the at least one microphone in response to the second calibration sound and while the computed calibration value is applied to the at least one microphone;

make a second comparison of a second predetermined level and the measured second level; and compute a second calibration value for the speaker using the second comparison.

11. The ANC-enabled portable audio device of claim 10, wherein the at least one microphone is located on the portable audio device in proximity to the speaker for providing a microphone signal indicative of an acoustic output of the speaker.

12. The ANC-enabled portable audio device of claim 10, wherein the at least one microphone comprises a plurality of microphones; and wherein the processing element is programmed to compute the calibration value for each microphone of all of the plurality of microphones of the portable audio device in response to a continuously-played instance of the calibration sound.

13. The ANC-enabled portable audio device of claim 12, wherein the processing element is programmed to compute the calibration value for each microphone of all of the plurality of microphones of the portable audio device in response to the continuously-played instance of the calibration sound while all the microphones are placed in a same acoustic space.

14. The ANC-enabled portable audio device of claim 10, wherein the at least one microphone comprises one or more of the following:

a reference microphone for use by an ANC system of the portable audio device;

an error microphone for use by the ANC system of the portable audio device; and a voice microphone.

15. The ANC-enabled portable audio device of claim 10, further comprising:

a non-volatile memory; and wherein the processing element is further programmed to store the computed calibration value in the non-volatile memory and subsequently read the computed calibration value to apply the computed calibration value to the at least one microphone.

16. The ANC-enabled portable audio device of claim 15, further comprising:

an integrated circuit that comprises the processing element and the non-volatile memory.

17. The ANC-enabled portable audio device of claim 10, wherein the portable audio device comprises a feedforward ANC system.

18. The ANC-enabled portable audio device of claim 10, wherein the processing element is further programmed to:

apply the computed calibration value to the at least one microphone;

test to determine whether a sensitivity of the calibrated at least one microphone is within a tolerance; and report whether the portable audio device passes or fails the test to a test station that is separate from the portable audio device.

19. The ANC-enabled portable audio device of claim 10, further comprising:

wherein the at least one microphone comprises a plurality of microphones; and a plurality of detectors configured to detect the levels of the measured audio signals of all the plurality of microphones concurrently in response to the calibration sound.

20. A method for calibrating an active noise cancellation (ANC)-enabled portable audio device having a speaker, at least one microphone, and a processing element, comprising:

measuring an audio signal transduced by the at least one microphone in response to a calibration sound;

making a comparison of a predetermined level and a level of the measured audio signal;

computing a calibration value for the at least one microphone using the comparison; and wherein said measuring the audio signal, said making the comparison, and said computing the calibration value are performed by the processing element within the ANC-enabled portable audio device;

causing the speaker to generate a second calibration sound;

measuring a second level of a second audio signal transduced by the at least one microphone in response to the second calibration sound and while the computed calibration value is applied to the at least one microphone;

making a second comparison of a second predetermined level and the measured second level; and computing a second calibration value for the speaker using the second comparison.

21. The method of claim 20, wherein the at least one microphone is located on the portable audio device in proximity to the speaker for providing a microphone signal indicative of an acoustic output of the speaker.

22. The method of claim 20, wherein the at least one microphone comprises a plurality of microphones; and wherein said measuring the audio signal, said making the comparison, and said computing the calibration value are performed by the processing element within the ANC-enabled portable audio device for all of the plurality of microphones of the portable audio device in response to a continuously-played instance of the calibration sound.

23. The method of claim 20, further comprising:

applying the computed calibration value to the at least one microphone;

testing to determine whether a sensitivity of the calibrated at least one microphone is within a tolerance; and reporting whether the portable audio device passes or fails the test to a test station that is separate from the portable audio device.

24. A method for calibrating an active noise cancellation (ANC)-enabled portable audio device having microphones, comprising:

playing continuously a calibration sound by a calibrated speaker of a test station that is separate from the portable audio device;

for each microphone of all the microphones of the portable audio device:

measuring a level of an audio signal transduced by the microphone in response to the continuously-played calibration sound;

making a comparison of a predetermined level and the measured level; and computing a calibration value for the microphone using the comparison;

wherein said measuring, said making the comparison and said computing the calibration value are performed for all of the microphones of the portable audio device without using a microphone of the test station;

wherein said measuring, said making the comparison and said computing the calibration value are performed for all of the microphones of the portable audio device in response to the continuously-played calibration sound; and wherein said making the comparisons and said computing the calibration values are performed by a processing element of a test station separate from the portable audio device.

25. A method for calibrating an active noise cancellation (ANC)-enabled portable audio device having microphones, comprising:

playing continuously a calibration sound by a calibrated speaker of a test station that is separate from the portable audio device;

for each microphone of all the microphones of the portable audio device:

measuring a level of an audio signal transduced by the microphone in response to the continuously-played calibration sound;

making a comparison of a predetermined level and the measured level; and computing a calibration value for the microphone using the comparison;

wherein said measuring, said making the comparison and said computing the calibration value are performed for all of the microphones of the portable audio device without using a microphone of the test station;

wherein said measuring, said making the comparison and said computing the calibration value are performed for all of the microphones of the portable audio device in response to the continuously-played calibration sound; and wherein said continuously playing the calibration sound by the calibrated speaker of the test station is performed while all the microphones of the portable audio device are in a free field.

26. An active noise cancellation (ANC)-enabled portable audio device, comprising:

microphones; and a processing element configured to, in response to a calibration sound continuously-played by a calibrated speaker of a test station that is separate from the portable audio device and without using a microphone of the test station, for each microphone of all the microphones of the portable audio device:

measure a level of an audio signal transduced by the microphone;

make a comparison of a predetermined level and the measured level; and compute a calibration value for the microphone using the comparison.

* * * * *